US006007321A

United States Patent [19]

Meckel et al.

[11] Patent Number: 6,007,321

[45] Date of Patent: Dec. 28, 1999

[54] UNITARY PAVER MOLD

[76] Inventors: Kevin Meckel, 7305 NE. 31st Ave., Vancouver, Wash. 98665; Alan L. Hoskins, 1207 NE. Whispering Winds Cir., Ridgefield, Wash. 98642; Kevin T. Litterell, 8205 NE. 29th Ave., Vancouver, Wash. 98665; Ronald J. Rowland, 2703 NE. 125th St., Vancouver, Wash. 98686; Brendan D. Scully, 3145 SW. Willow Pkwy, Gresham, Oreg. 97080; Llewellyn L. Johnston, 11108 NE. 26th Ave., Vancouver, Wash. 98682

[21] Appl. No.: 09/007,559

[22] Filed: Jan. 15, 1998

Related U.S. Application Data

[63] Continuation-in-part of application No. 08/923,785, Sep. 4, 1997, abandoned.

[51] Int. Cl.[6] ..... B28B 7/24

[52] U.S. Cl. ..... 425/432; 249/119; 249/139; 425/253; 425/470

[58] Field of Search ..... 249/117, 119, 249/120, 139; 425/253, 432, 453, 470

[56] References Cited

U.S. PATENT DOCUMENTS

| | | | |
|---|---|---|---|
| 798,797 | 9/1905 | Johnson . | |
| 1,642,247 | 9/1927 | Krause . | |
| 1,652,855 | 12/1927 | Fernandez . | |
| 1,688,627 | 10/1928 | Long . | |
| 1,887,403 | 11/1932 | Evans . | |
| 2,091,139 | 8/1937 | Crowell . | |
| 2,121,439 | 6/1938 | Menzel . | |
| 2,904,870 | 9/1959 | Hillberg . | |
| 3,360,231 | 12/1967 | Van Hezik . | |
| 4,123,034 | 10/1978 | Crunk et al. . | |
| 4,442,995 | 4/1984 | Grady, II . | |
| 4,451,022 | 5/1984 | Sauger . | |
| 5,049,193 | 9/1991 | Baxter . | |
| 5,059,110 | 10/1991 | Allison et al. . | |
| 5,297,772 | 3/1994 | Stefanick . | |
| 5,395,228 | 3/1995 | Aeseth et al. | 425/432 |
| 5,542,837 | 8/1996 | Johnston . | |
| 5,743,510 | 4/1998 | Johnston | 249/168 |

FOREIGN PATENT DOCUMENTS

| | | |
|---|---|---|
| 630.230 | 7/1963 | Belgium . |
| 508.048 | 12/1919 | France . |
| 25 56 511 | 6/1977 | Germany . |
| 856809 | 8/1981 | U.S.S.R. . |

OTHER PUBLICATIONS

Columbia Machine, "Mold Box Assembly", pp. 2.4–2.5 (1994).

Columbia Machine, "Mold Adaptor (C–200–2269)", (1980).

Columbia Machine, "Adaptor—Final Machining (B699582.25.1)", (1990).

Columbia Machine, "Mold Box Assembly", pp. 2.1–2.105 (1994).

Columbia Machine, "Mold Adaptor (D–200–3124)", (1986).

*Primary Examiner*—James P. Mackey

*Attorney, Agent, or Firm*—Marger Johnson & McCollom, P.C.

[57] ABSTRACT

A unitary concrete product mold formed from a central member having an array of product-shaping molds bounded by side and end portions. Support rails mounted on the bottom surface of the central member limit deflection of the central portion of the central member, improving product quality and reducing mold wear.

10 Claims, 11 Drawing Sheets

UNITARY PAVER MOLD

RELATED APPLICATION

This is a continuation-in-part application of U.S. Ser. No. 08/923,785, filed Sep. 4,1997, now abandoned.

BACKGROUND OF THE INVENTION

The present invention relates to a mold for forming molded concrete products, and, more particularly, to a unitary mold for forming molded concrete products.

There are several problems that occur with prior art machines for forming concrete products which have previously been disclosed and addressed in earlier filed applications. A novel method and apparatus for forming concrete products was designed for the high speed manufacturing of a wide variety of high quality products was disclosed in U.S. Pat. No. 5,395,228 to Aeseth et al., for Apparatus for Forming Concrete Products and is incorporated herein by reference. That invention increased vibration control in a concrete product forming machine, reduced the amount of time required to mold concrete products, increased the homogeneous consistency of concrete products, and reduced the amount of time required to exchange and align molds in a concrete product forming machine.

A novel self-aligning mold box assembly for use in a machine for forming concrete products, such as the machine disclosed in U.S. Pat. No. 5,395,228 to Aeseth et al., is disclosed in my U.S. Pat. No. 5,743,510, and which is directed to the mold box depicted in FIG. 1.

Another novel mold box assembly for use in a machine for forming concrete products, such as the machine disclosed in U.S. Pat. No. 5,395,228 to Aeseth et al., is disclosed in my U.S. Pat. No. 5,542,837 for Method and Apparatus for Securing Partition Plates in a Mold, and incorporated herein by reference.

While both the machine for forming concrete products disclosed in U.S. Pat. No. 5,395,228 to Aeseth et al. and the two new mold box assemblies disclosed in my U.S. Pat. No. 5,743,510 and my U.S. Pat. No. 5,542,837 have substantial advantages over the prior art, each involves the use of mold box assemblies which in and of themselves impose limitations on product throughput, and which require labor-intensive assembly prior to use.

Turning now to FIG. 1A, included therein is an exploded view of a prior art paver grid assembly 100, which includes a paver grid 110 and a paver grid frame 112. In operative condition, paver grid 100 is secured to and contained within frame 112. The upper surfaces of the paver grid and frame are substantially coplanar when the grid and frame are in operative condition.

Paver grid frame 112 includes a pair of opposed mounting brackets 114, 116. Each of the mounting brackets has a pair of upwardly directed mounting surfaces, like surfaces 118, 120 on bracket 114. Each mounting surface 118, 120 includes a pair of bolt holes therethrough. Mounting bracket 116 includes mounting surfaces and bolt holes that are substantially symmetrical with mounting surfaces 118, 120 and the bolt holes therein.

A head assembly 122 is, in operative condition, mounted on a machine for making concrete products like that shown in FIG. 1B. The head assembly includes plurality of compression shoes, like shoe 124, that are aligned with corresponding cavities in paver grid 110, also mounted on the machine.

When the paver grid assembly 100 and head assembly 122 are mounted on the machine, wet concrete product is poured into the cavities in paver grid 110. After wet product is poured into the paver grid, the machine moves head assembly downwardly and the shoes, like shoes 124, compress the product into the paver grid cavities. After sufficient compression, a pallet 126 lowers concurrently with head assembly 122 thus stripping the molded pavers from the grid and leaving them arranged on the pallet as shown in FIG. 1A.

Turning now to FIG. 1B, indicated generally at 128 is a machine for molding concrete blocks and pavers. Included therein are four blocks, like block 130, arranged on pallet 126. In the view of FIG. 1B, the mold that formed blocks 130 has been removed from the machine. Part of the mounting structure for that mold, as well as for paver grid assembly 100, however, is visible. The visible portion of the mounting structure comprises a die support 130. A pair of bolt heads can be seen extending downwardly from die support 131. Before mounting paver grid assembly 100 on machine 128, the bolts are removed and mounting surface 120 (FIG. 1A) is urged against the lower surface of die support 130. Each of the other mounting surfaces on paver grid assembly 100 are urged against corresponding die supports (not visible). The bolts visible in FIG. 1B are thereafter used to bolt each of the mounting surfaces firmly against the underside of the die support thereby securing paver grid assembly on machine 130.

The mold box is vibrated by a pair of opposed vertical vibrating rods 132, 133. Another die support (not visible) is located adjacent rod 133. As can be see in FIG. 1A, a semicircular notch between mounting surfaces 118, 120 is formed to accommodate vibrating rod 132. Vibrating rod 133 is similarly accommodated by corresponding structure (not visible) on mounting bracket 116.

The vibrating rods, like rod 132, vibrate the mold while the shoes, like shoe 124, compact wet concrete product into the cavities. The vibration during compaction increases density, and therefore strength, of the molded concrete product.

Mold boxes are still used because heretofore, molds have been limited to the equivalent of three "16 inch blocks" per mold. The maximum of three "sixteens" per mold has long been recognized as the practical upper limit to the size of a mold which can withstand the high-speed, low-displacement vibration applied to the mold to compact the green concrete once in the mold. In order to increase the "per cycle" throughput of concrete product molding machines, apparatus and methods have been developed in which multiple individual 3—8"×8""16× molds are inserted into a single "mold box", which in turn is mounted on the forming machine as described generally in the references discussed above. While notable advances have been realized in "mold box" technology, the mounting of multiple molds in mold boxes nonetheless represents a significant limitation in the production of formed concrete products.

SUMMARY OF THE INVENTION

Accordingly, it is a general object of the present invention to provide an apparatus which obviates the need to assemble provide a mold box for supporting multiple molds as part of a mold assembly.

It is a further object of the present invention to provide a unitary mold for the forming of cast concrete products which includes a greater number of product-shaping voids than individual prior art molds, while still providing adequate support for the green concrete during compaction without the need for an external, peripheral frame.

It is yet a further object of the invention to provide a unitary mold which retains the advantages associated with using multiple molds inserted into and supported by an external mold box.

These and other objects and advantages are accomplished by providing a unitary a mold defining a plurality of cavities for receiving cement which in number exceed that heretofore achievable, and which does not require a mold box for support. The unitary mold of the present invention includes upper and lower surfaces, opposed side and end portions, and internal surfaces which define a plurality of concrete-receiving voids. In the preferred embodiment, mounting spacers are mounted on the lower surface of the unitary mold adjacent each end. The mounting spacers include precisely positioned holes for receiving locating pins to precisely locate the unitary mold on a support surface. Also mounted on the bottom surface adjacent each side are mounted longitudinal support rails. The longitudinal support rails, in conjunction with the side portions of the limit the vertical deflection when the unitary mold is vibrated to compact the wet concrete. Thus, it can be appreciated that my novel apparatus disclosed above can be used as an alternative to smaller-sized molds inserted into external mold boxes in any concrete product forming machine having a larger mold box support frame.

The foregoing and other objects, features and advantages of the invention will become more readily apparent from the following detailed description of a preferred embodiment which proceeds with reference to the drawings.

DETAILED DESCRIPTION OF THE PREFERRED EMBODIMENT

Figures 2, 2A, 3, 3A:
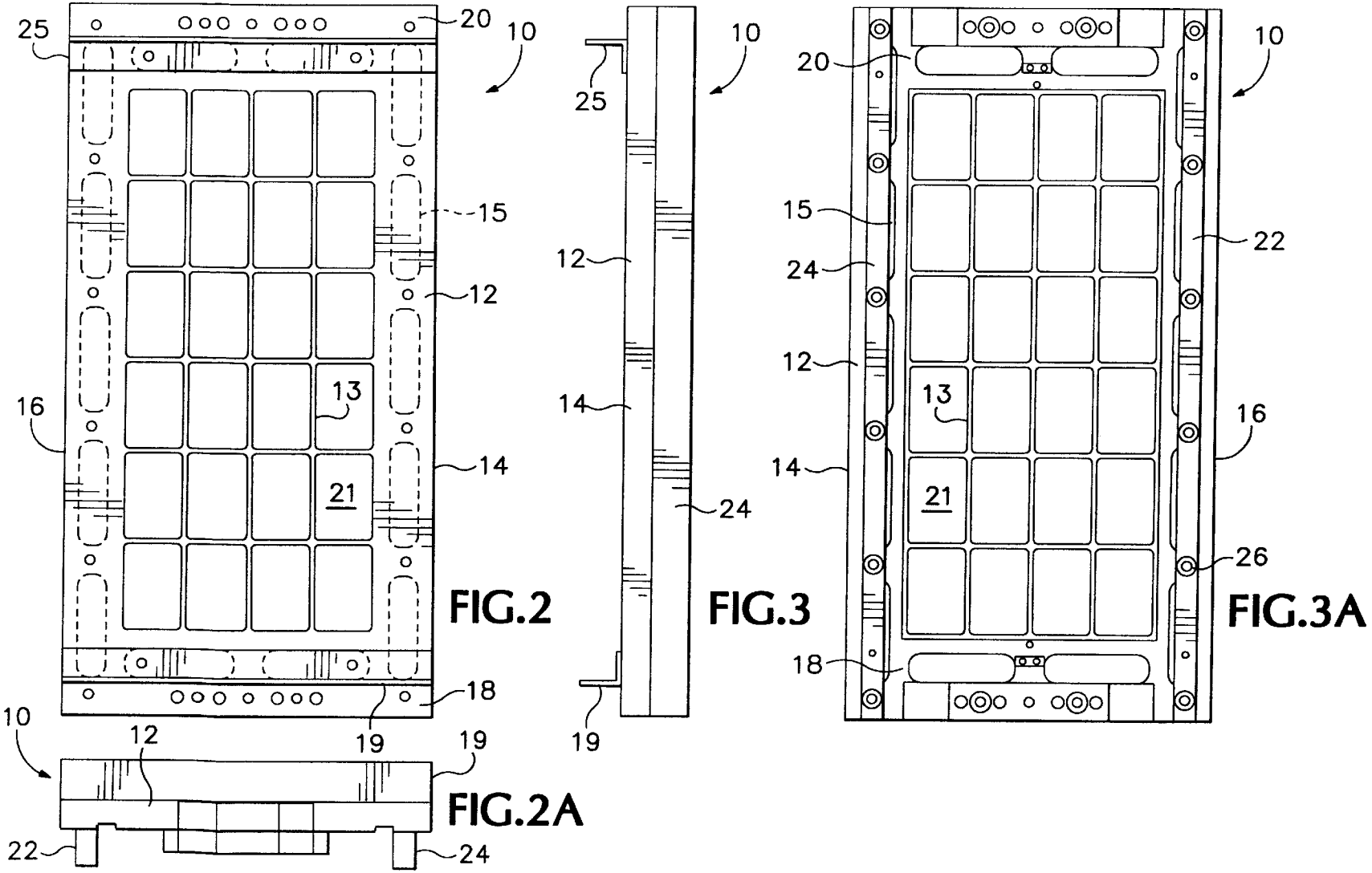
FIG. 2 is a top plan view of the unitary mold according to the present invention.
FIG. 2A is an end view of the unitary mold shown in FIG. 2.
FIG. 3 is a side view of the unitary mold shown in FIG. 2.
FIG. 3A is a bottom plan view of the unitary mold shown in FIG. 2.
Figures 4, 4A, 5, 5A, 6:
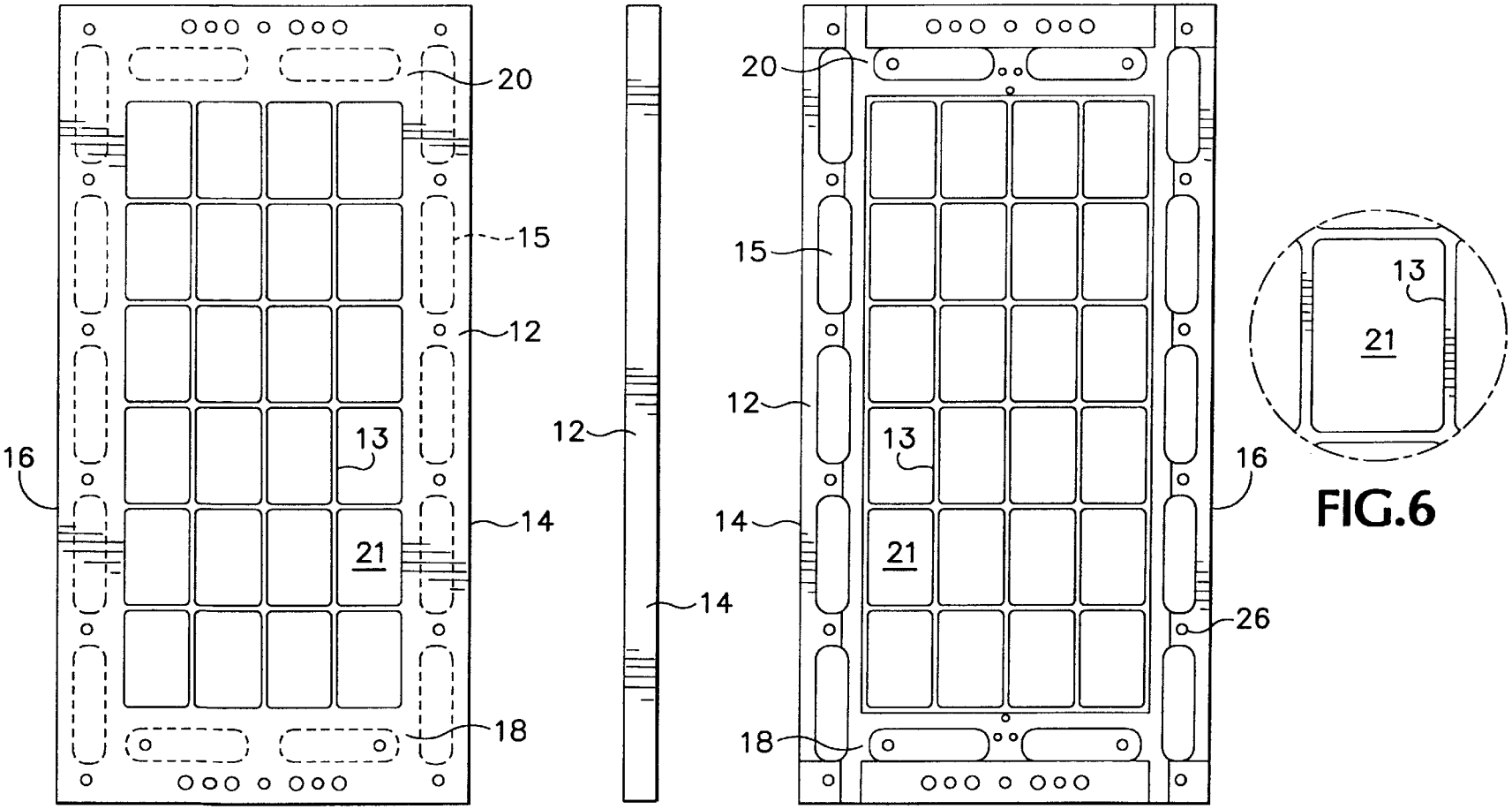
FIG. 4 is a top plan view of the central mold grid which is incorporated in the embodiment shown in FIG. 2.
FIG. 4A is an end view of the central mold grid shown in FIG. 4.
FIG. 5 is a side view of the central mold grid shown in FIG. 4.
FIG. 5A is a bottom plan view of the central mold grid shown in FIG. 4.
FIG. 6 is a partial enlarged bottom plan view of the central mold grid shown in FIG. 4 showing in greater detail a typical mold opening.
Figure 7:
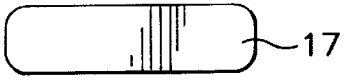
FIG. 7 is a top plan view of a cover plate used to cover the peripheral voids formed in the central mold grid of FIG. 4.
Figure 15:
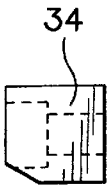
FIG. 15 is an end view of the pallet guide shown in FIG. 14.

Turning now to FIGS. 2–6, indicated generally at 10 in FIG. 2 is a unitary paver mold incorporating the present invention. Unitary paver mold 10 includes a mold grid member shown generally at 12 which includes a central mold grid 13 disposed within sides 14 and 16, and ends 18 and 20. Mold grid 13 defines multiple openings 21 which are shaped to form concrete to the desired shape, and which are open on the top and bottom (FIG. 6). Openings 15 are formed in mold grid member 12 to equalize the thermal mass distribution across the span of the mold grid member. Equalization of the thermal mass promotes even heating and cooling of the member during heat treating, and results in less distortion of the member during heating and cooling. Each opening 15 is covered by a plate 17 as shown in FIG. 7, and which is welded into place on the top surface of the mold grid member 12. Mounted on the upper surface of the mold grid member 12 are pan angles 19 and 25 which serve to contain wet concrete in the mold grid member.

Figure 8:
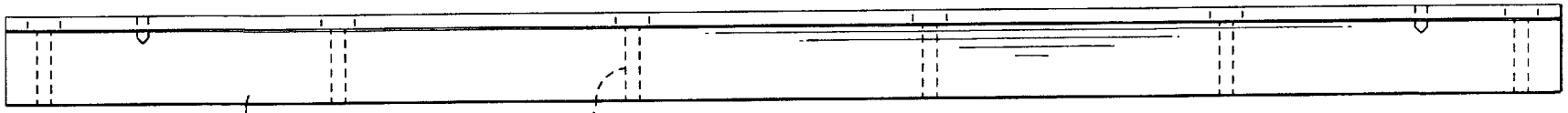
FIG. 8 is a side view of the longitudinal support member shown in FIG. 3A.
Figure 9:
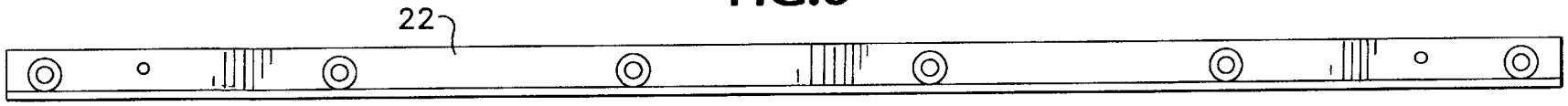
FIG. 9 is a top view of the longitudinal support member shown in FIG. 8.

Turning additionally to FIGS. 8 and 9, unitary paver mold 10 includes longitudinal support rails 22 and 24 which are mounted with bolts 26 to the bottom surfaces of sides 14 and 16 respectfully, and which are parallel to and positioned outside of the lateral edges of mold grid 12. Support rails 22 and 24 in the preferred embodiment are 5" tall and serve to limit deflection of the mold grid member as described more fully below.

Figure 14:
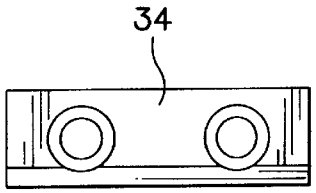
FIG. 14 is a top plan view of the pallet guide which is mounted on the unitary paver mold shown in FIG. 2.
Figure 10:
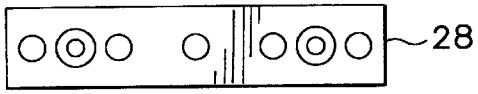
FIG. 10 is a bottom plan view of a mounting spacer which is mounted on the bottom surface adjacent each end of the unitary mold shown in FIG. 2
Figure 11:
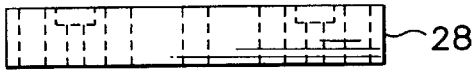
FIG. 11 is a side view of the mounting spacer shown in FIG. 10.
Figure 12:
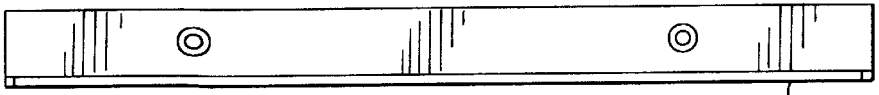
FIG. 12 is a top plan view of the pan angle which is mounted on the unitary paver mold shown in FIG. 2.
Figure 13:
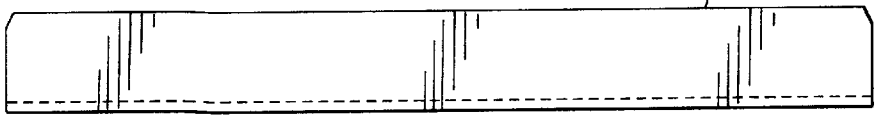
FIG. 13 is a side view of the pan angle shown in FIG. 12.
Figure 16:
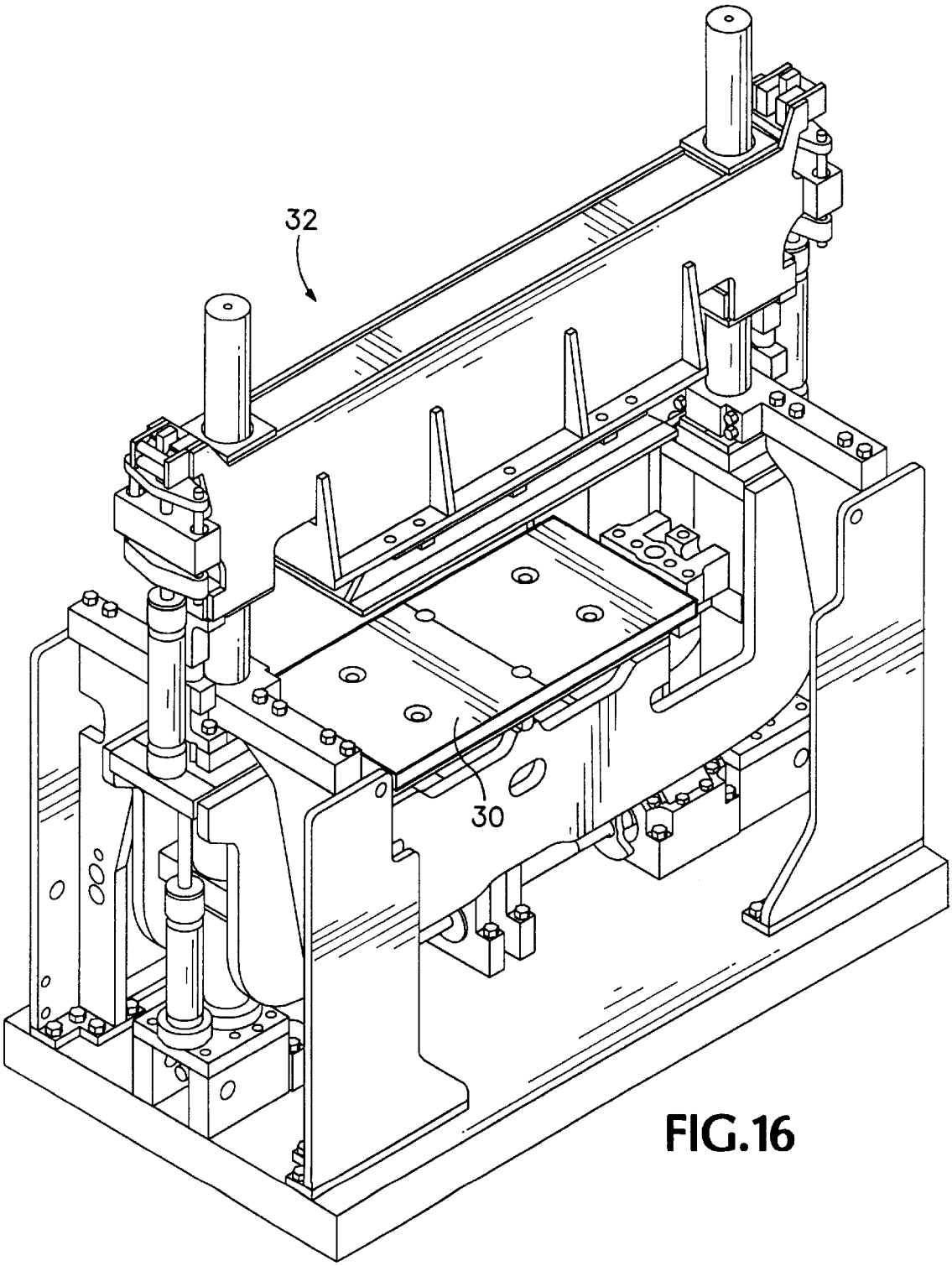
FIG. 16 is a perspective view of a concrete molding machine of the type on which a unitary mold shown in FIG. 2 is mounted.
Figure 17:
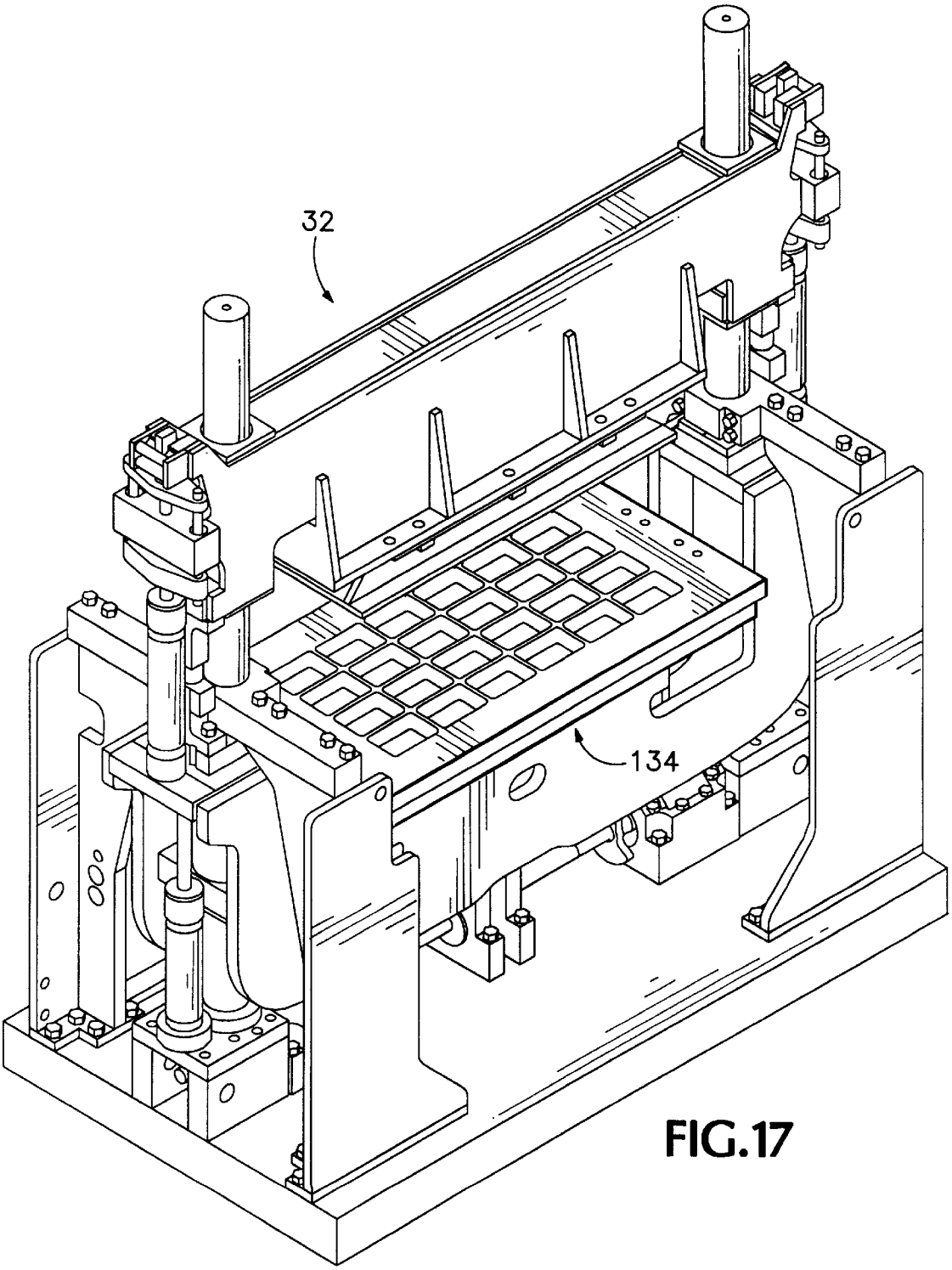
FIG. 17 is a perspective view of the concrete molding machine shown in FIG. 16 with the unitary mold of FIG. 2 mounted thereon.

Turning to FIGS. 10–17, a mounting spacer 28 is mounted on the lower surface of the mold grid 12, and serves to precisely space the unitary paver grid 10 above a supporting platen 30 in the molding machine 32 as shown in FIGS. 16 and 17. Once installed in the molding machine, a unitary paver mold according to the present invention is filled with wet concrete, the wet concrete is compacted by a pneumatically activated press 34 as shown in FIG. 14. To aid in the compaction of the wet concrete, the filled mold assembly is vibrated at a relatively high frequency, e.g. 50 hz., and a displacement of from 0.050 to 0.100". Doing so naturally exerts high bending moments in the mold. In the past, attempts at providing a mold larger in size than the equivalent of 3—8"×8"×16" blocks have not been successful because such molds, when subjected to vibratory compaction at the levels discussed above, have exhibited excessive vertical bending around the longitudinal mid-point of the mold. It is applicant's experience that vertical bending displacements at the midpoint of the mold which are greater than about 0.010" result in unacceptably poor quality in the resulting molded products and increased wear on the cavity surface. Applicant's invention provides, for the first time, a unitary mold which has a capacity of greater than the equivalent of 3—8"×8"×16" blocks, which exhibits acceptably low bending displacement during vibratory compaction of the wet concrete, and which is readily easily used with existing molding machine designs. In the preferred embodiment, a paver mold as shown in FIGS. 2–3A, when vibrated at 50 hz. and a displacement of 0.090" exhibited vertical bending at its longitudinal midpoint of approximately 0.0085", which is well within the acceptable maximum of 0.010".

Figure 1:
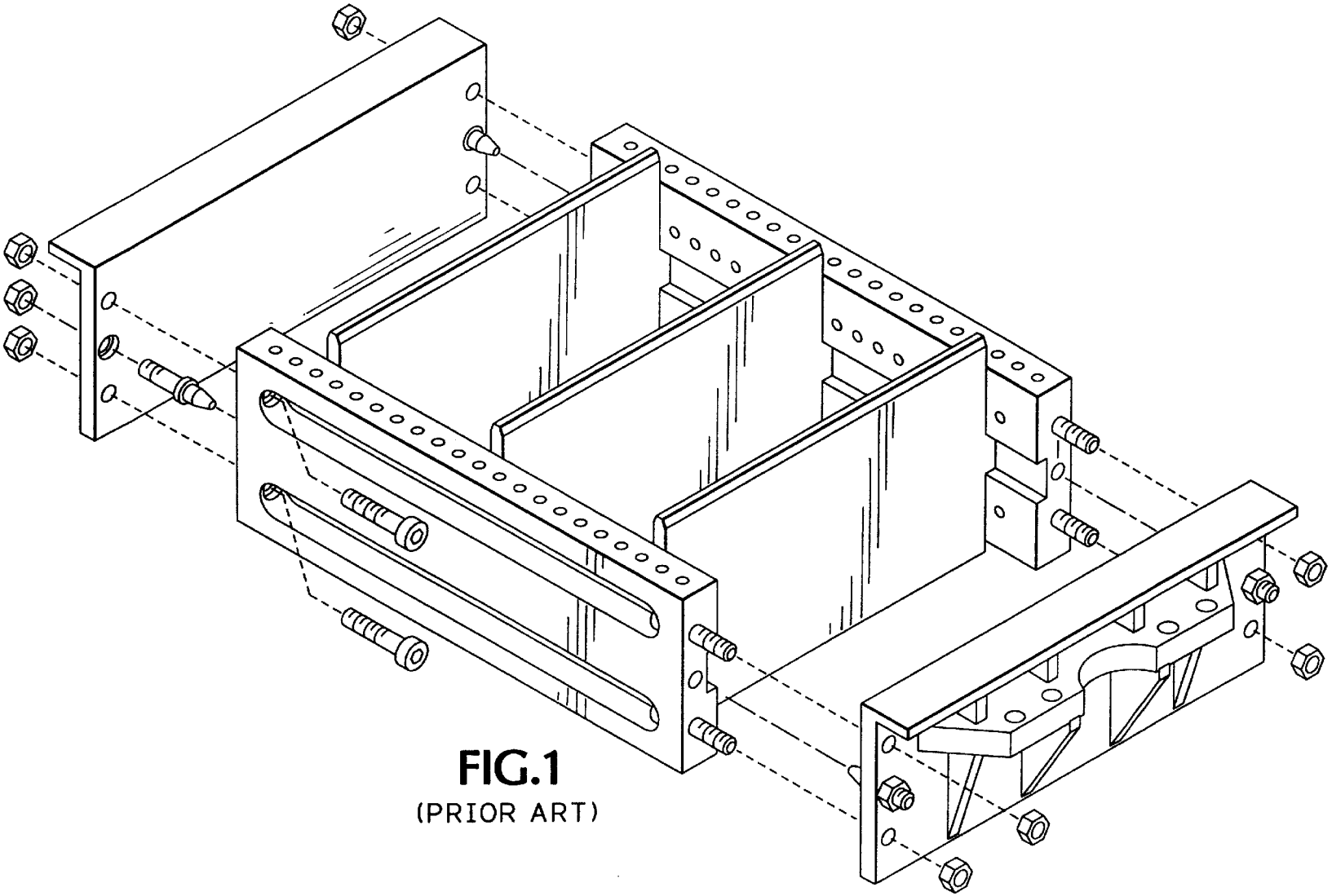
FIG.1 (PRIOR ART)
FIG. 1 is an exploded perspective view of a prior art mold box assembly.
Figure 1A:
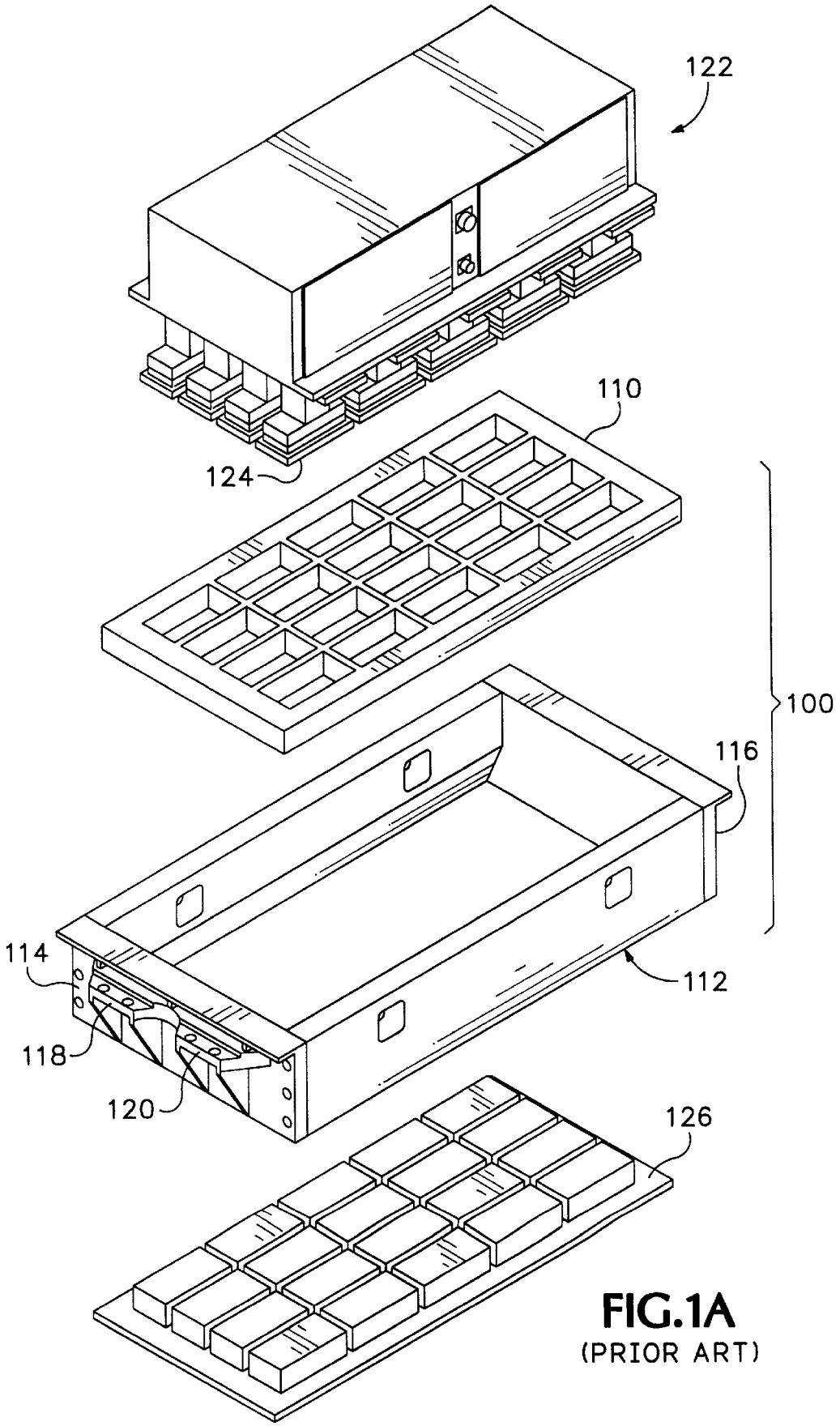
FIG.1A (PRIOR ART)
FIG. 1A is an exploded perspective view of a prior art head assembly, paver grid assembly, and pallet.
Figure 18:
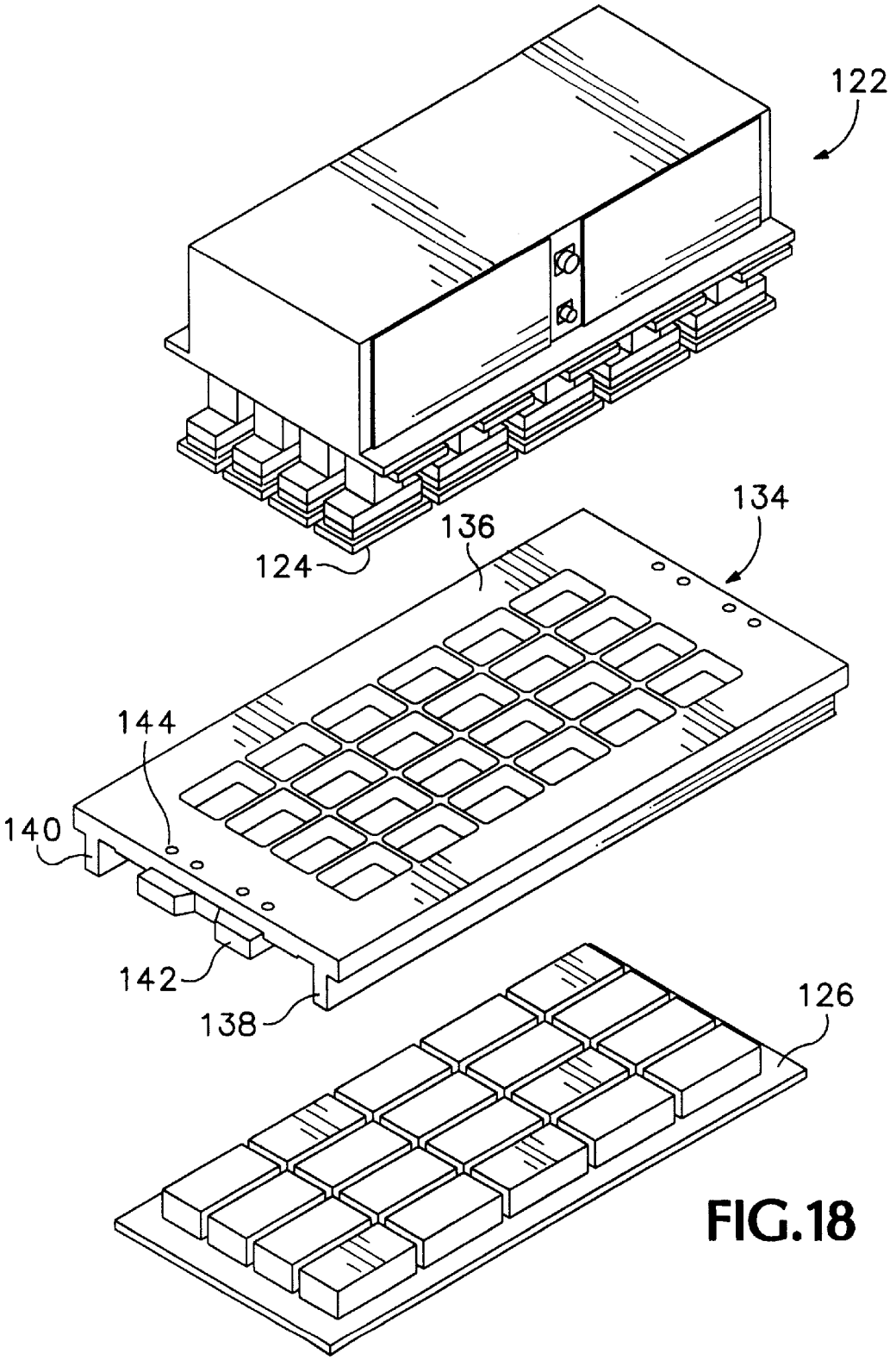
FIG. 18 is an exploded perspective view of a head assembly, a paver grid (being another embodiment of the present invention), and pallet.
Figure 19:
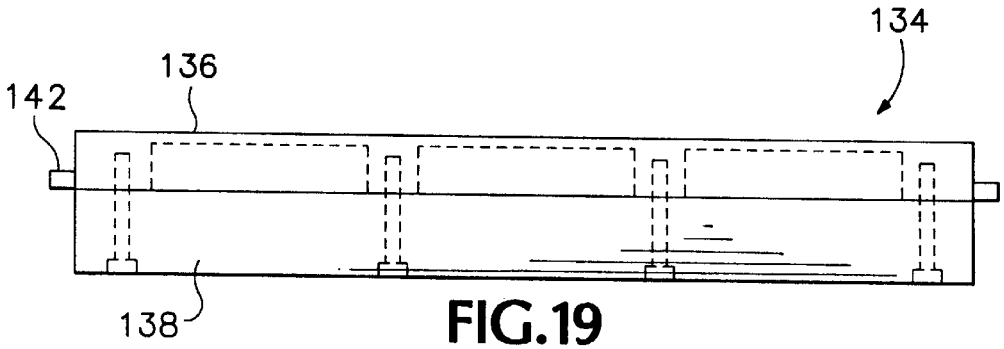
FIGS. 19, 20 and 21 are side, plan and left-end views of another paver grid embodiment of the invention.
Figure 20:
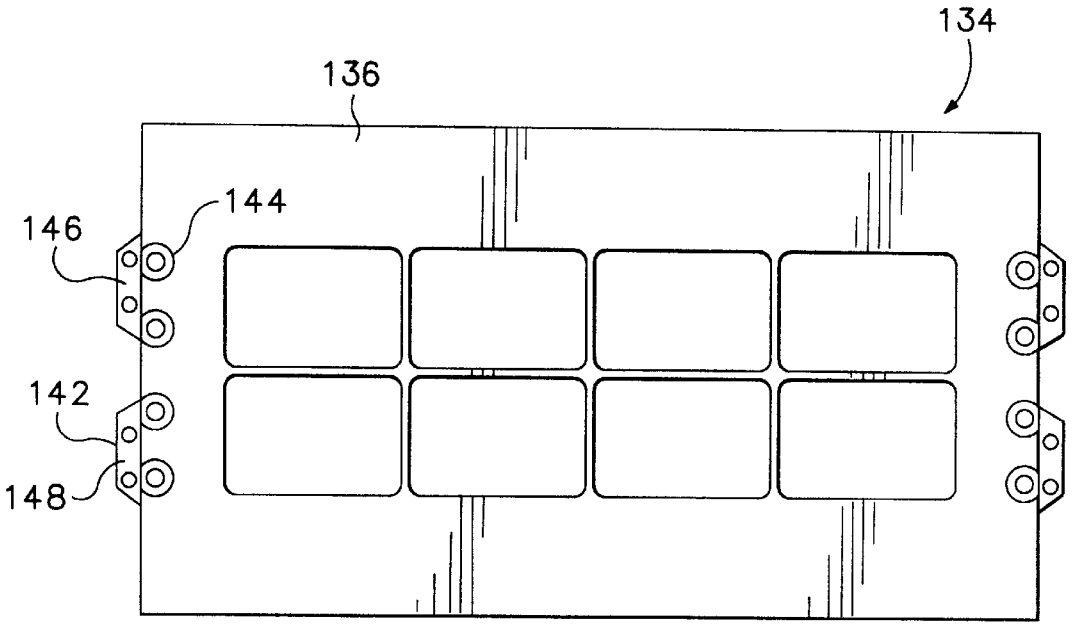
Figure 21:
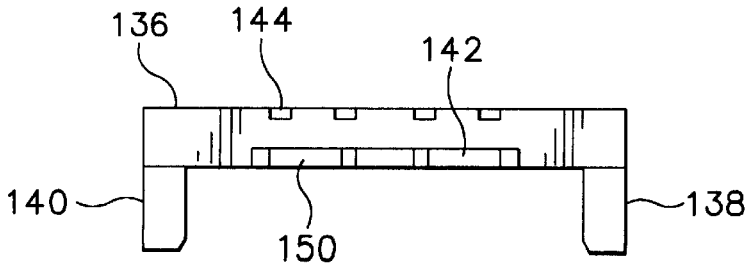
Figure 22:
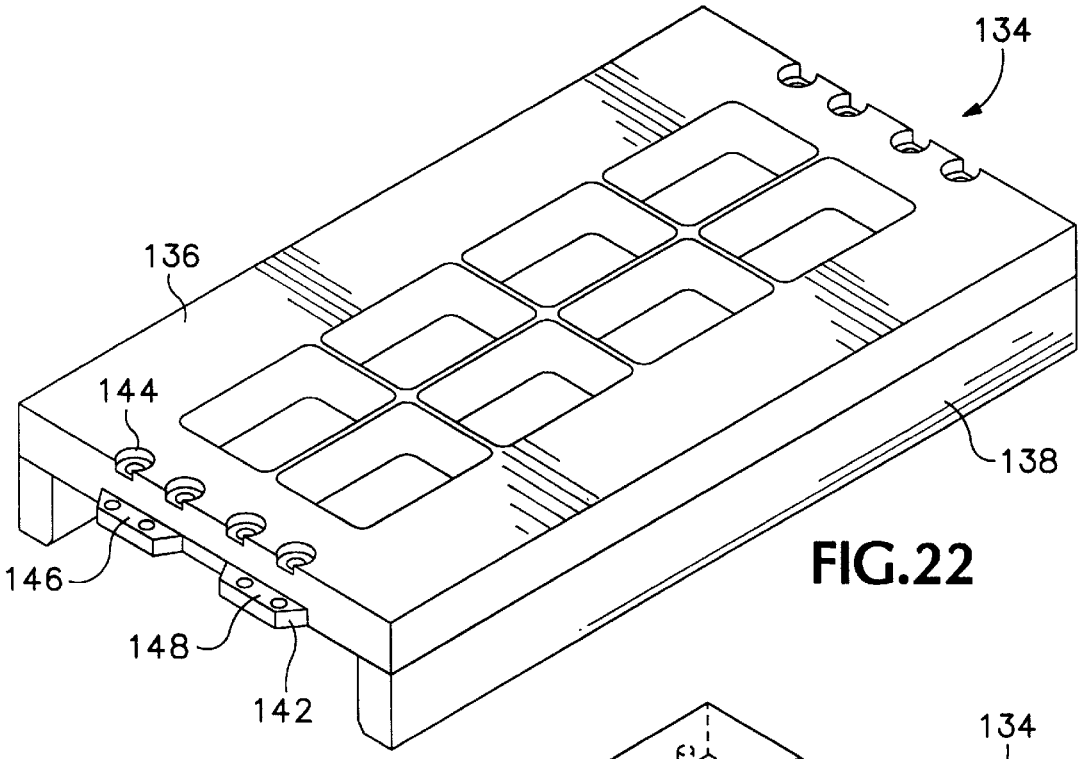
FIG. 22 is a perspective view of the paver grid of FIGS. 19–21.
Figure 23:
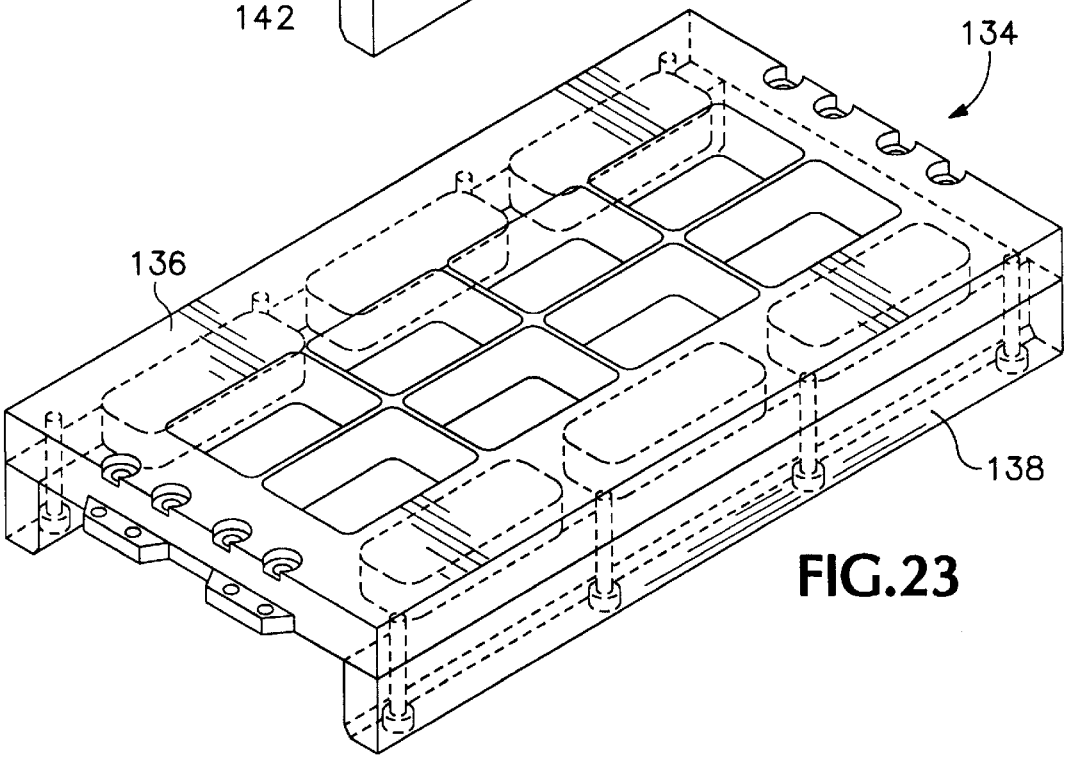
FIG. 23 is a view similar to FIG. 22 depicting hidden structure and dashed lines.

In FIG. 18, head assembly 122 and pallet 126 are substantially identical to those described in FIG. 1A and retain corresponding identifying numerals in FIG. 18. Paver grid 134 is constructed in accordance with the present invention and includes a substantially planar grid plate 136 in which a plurality of cavities are formed for molding concrete pavers, like those shown on pallet 126. A pair of stiffener rails 138, 140 are bolted to the underside of grid plate 136 as shown. Each end of grid plate 136 includes a mounting plate, like mounting plate 142, bolted thereto via bolts (not shown) received in four bores, like bore 144, in grid plate 136.

In FIGS. 19–23 another embodiment of the paver grid depicted in FIG. 18 is shown. As can be seen, it includes larger cavities, and therefore a fewer number of cavities, for molding larger concrete products than the paver grid in FIG. 18. Numerals corresponding to those used in FIG. 18, however, are used in FIGS. 19–23 to identify similar structure.

Each mounting plate includes a pair of upwardly directed mounting surfaces, like surfaces 146, 148 on mounting plate 142. Mounting plate 142 is received in a recess 150 formed on the underside of grid plate 136, as best view in FIG. 21. Plate 142 is secured to grid assembly 136 via four bolts (not shown) received through countersunk bores, like bore 144, in grid plate 136, and coaxial bores (visible in dashed lines in FIG. 23) in the mounting plate. Rails 138, 140 are likewise bolted to the underside of grid plate 136.

Figure 1B:
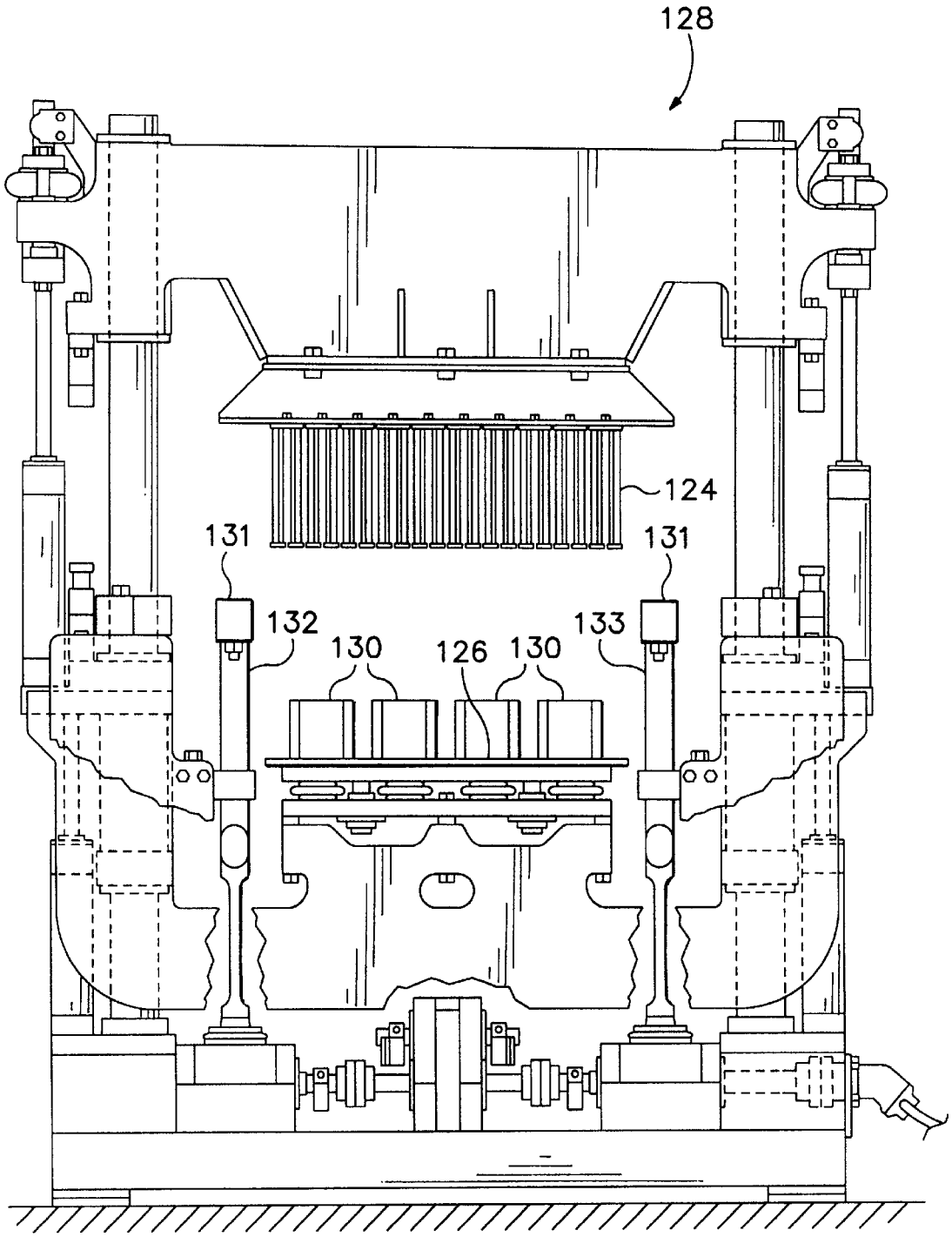
FIG. 1B (PRIOR ART)
FIG. 1B is a perspective view of a prior art machine that can incorporate the structure depicted in FIG. 1A to make pavers.

In operation, mounting surfaces 146, 148 are urged against the underside of the die supports, like die support 131, on machine 128 (FIG. 1B) and are thereafter bolted in the same fashion as the prior art paver grid assembly of FIG. 1A. Molding a product thereafter proceeds as previously described, and as is well known in the art. Stiffener rails 138, 140 prevent excessive flexing of paver grid 136 during the manufacturing process. Paver grid assembly 134 is cheaper to make than the prior art paver grid of FIG. 1A because it has fewer parts. In addition, the sides of the grid need not be machined to fit in a frame as in the prior art. Only the undersurfaces to which the rails and mounting plates are bolted need be machined to permit securing parts together.

While a preferred construction for, and methods of practicing the invention have been disclosed herein, it is appreciated that variations and modifications may take place without departing from the spirit of the invention.

We claim:

1. A unitary concrete product-forming mold comprising:

a unitary body having opposed longitudinal side walls, opposed end walls, and a central portion defining a unitary array of product-forming cavities formed through the body, the central portion having a longitudinal midpoint;

the array of product-forming cavities including at least four cavities in the longitudinal dimension; and the body having a bottom surface and a pair of longitudinal support rails mounted thereon.

2. A unitary concrete product-forming mold according to claim 1 wherein the longitudinal midpoint has a bending deflection of not more than 0.010 inches responsive to the mold being vibrated at approximately 50 Hz. and 0.090" displacement.

3. A unitary concrete product-forming mold according to claim 1 wherein the longitudinal rails are laterally offset from the array of product-forming cavities.

4. A concrete product-forming mold comprising:

a unitary body having a peripheral edge defined by laterally separated side edges and longitudinally separated end edges;

an array of cavities formed through the unitary body and passing from an upper surface of the unitary body to a lower surface; and a pair of stiffener rails formed longitudinally along the unitary body and secured to the lower surface of the unitary body outside of the array of cavities and adjacent the side edges so that a pallet can be moved into position against an underside of the cavities to strip out concrete products formed within the cavities and forced out during a stripping process.

5. The concrete product forming mold of claim 4, further including a plurality of supplemental openings formed through the unitary body adjacent the side edges and outside the array of cavities to equalize a thermal mass distribution across a lateral extent of the unitary body during heating and cooling.

6. The concrete product forming mold of claim 5 wherein at least one of the stiffener rails is mounted on the lower surface of the unitary body over the supplemental openings.

7. The concrete product forming mold of claim 4, further including a pair of pan angles mounted on the upper surface of the unitary body adjacent the end edges and outside of the array of cavities which serve to contain wet concrete as it is poured into the array of cavities.

8. The concrete product forming mold of claim 4, further including a mounting spacer secured to and extending below the lower surface of the unitary body adjacent the end edges so that the mold can be precisely spaced above a supporting platen on a concrete products forming machine during concrete products manufacturing.

9. The concrete product forming mold of claim 4, further including a mounting plate secured adjacent each end edge and having a pair of upwardly directed mounting surfaces.

10. The concrete product forming mold of claim 9, further including a recess formed in the lower surface of the unitary body adjacent each end edge, said mounting plate being secured within the recess.

* * * * *